US012269655B2

(12) United States Patent
Comerford

(10) Patent No.: US 12,269,655 B2
(45) Date of Patent: Apr. 8, 2025

(54) SHIPPING CONTAINER SYSTEMS

(71) Applicant: Brent Michael Comerford, Aliso Viejo, CA (US)

(72) Inventor: Brent Michael Comerford, Aliso Viejo, CA (US)

( * ) Notice: Subject to any disclaimer, the term of this patent is extended or adjusted under 35 U.S.C. 154(b) by 0 days.

(21) Appl. No.: 17/072,646

(22) Filed: Oct. 16, 2020

(65) Prior Publication Data

US 2022/0119149 A1 Apr. 21, 2022

(51) Int. Cl.
*B65D 5/50* (2006.01)
*B65D 5/20* (2006.01)
*B65D 81/07* (2006.01)

(52) U.S. Cl.
CPC ..... *B65D 5/5021* (2013.01); *B65D 5/2057* (2013.01); *B65D 81/07* (2013.01)

(58) Field of Classification Search
CPC ..... B65D 5/5021; B65D 5/2057; B65D 81/07
USPC ..... 206/583
See application file for complete search history.

(56) References Cited

U.S. PATENT DOCUMENTS 7,753,209 B2 * 7/2010 McDonald ..... B65D 5/5021 206/583
8,307,984 B1 * 11/2012 Collier ..... B65D 81/05 229/87.02
9,725,230 B2 * 8/2017 Huang ..... B65D 59/04
9,828,160 B2 * 11/2017 Ridgeway ..... B65D 81/07
2006/0213803 A1 * 9/2006 Saitou ..... B65D 81/05 206/583
2010/0140333 A1 * 6/2010 Mcdonald ..... B65D 5/5021 220/6
2015/0314936 A1 * 11/2015 Stack, Jr. ..... B65D 5/5035 206/488

* cited by examiner

*Primary Examiner* — J. Gregory Pickett
*Assistant Examiner* — Jenine Pagan
(74) *Attorney, Agent, or Firm* — Camuti Law Group APC; Nathan Camuti

(57) ABSTRACT

There is provided a container system comprising an outer container comprising a base and a plurality of upstanding walls defining a cavity, a closure flap extending from a top of one of the upstanding walls wherein the first closure flap covers an opening formed by the top ends of the upstanding walls when the outer container is in a closed configuration, and wherein the closure flap includes a retention element that extends from the closure flap downward into the cavity of the outer container when the outer container is closed, and an suspension insert including a product retention compartment and a plurality of suspension units extending outwardly from the suspension unit creating a suspension gap on all sides of the product retention compartment when the suspension insert is installed in the outer container, wherein the retention element exerts a retention force on a the suspension insert.

17 Claims, 6 Drawing Sheets

SHIPPING CONTAINER SYSTEMS

BACKGROUND

Shipping products to consumers has become a vital part of our everyday lives. Shipping containers are typically designed to maximize efficiency in packing shipping vehicles. Frequently, a shipping container contains items that fill only a small portion of the volume of the container, requiring the space to be filled with other material, such as air-filled plastic pouches or shredded paper. Alternative solutions include affixing products to a piece of cardboard using plastic film of sorts and adding some pieces to cause the plastic wrapped board and product to remain positioned in the cavity of the box. Existing solutions are expensive and use excess materials, including excessive waste materials. More economical and ecologically friendly systems are needed.

SUMMARY

The present disclosure is directed to shipping container systems, substantially as shown in and/or described in connection with at least one of the figures, as set forth more completely in the claims. In one embodiment of the present disclosure, the shipping container system includes an outer container having a base, a plurality of upstanding walls extending from the base, the base and upstanding walls defining a cavity. The upstanding walls include a corresponding plurality of closure flaps. The corresponding plurality of flaps may overlay the base and substantially cover the opening of the cavity when the outer container is in a closed configuration. The plurality of closure flaps may be hingedly attached to the ends of the upstanding walls opposite the base. At least one of the corresponding plurality of closure flaps may include a securing element extending from a side of the closure flap such that the securing element may be oriented to fit downwardly into the cavity of the outer container when the closure flaps are in a closed configuration. At least one other of the corresponding plurality of flaps may be paired with the at least one of the corresponding plurality of closure flaps having the securing element, the one other having a corresponding aperture for receiving the securing element when the outer container is in a closed configuration.

The shipping container system may further include a suspension insert. The shipping suspension insert may include a product retention compartment extending from a first end to a second end opposite the first end, the product retention compartment including a selectively closeable flap on either end extending from a lower section of the product retention compartment and substantially covering and closing the end of the product retention compartment. The suspension insert further comprises a suspension unit connected to and extending from an upper section of the product retention compartment. The suspension unit includes width securing elements extending outwardly beyond the width of the product retention compartment sufficient to substantially fill the width of the outer container to hold the product retention compartment secure in the width of the outer container and leaving a gap between the upstanding walls of the outer container and the product retention compartment.

In other embodiments, the suspension insert may include a plurality selectively closeable flaps on either end of the product retention compartment. The selectively closable flap may be hingedly attached to the lower section of the product retention compartment. In some embodiments, the selectively closable flap may include an additional structural support element cut out of the lower section of the product retention compartment and configured so that the additional structural support element rotates downwardly to create an additional lower support to the suspension insert when the selectively closable flap is hingedly rotated upward to a closed configuration, substantially covering the open end of the product retention compartment. The additional structural support element may extend downwardly to the base of the outer container. Thus, when the suspension insert is in the closed configuration and installed in the outer container, the suspension insert may secure the product retention compartment in the length, width, and height of the outer container, and the additional structural support element may add additional structural support to the system, strengthening the system in a downward direction securing the product retention compartment in the outer container.

The shipping container system of the present disclosure may be made from corrugated board, paper board, flexible plastics, foamed plastics, rigid plastics, corrugated plastics, or any combination thereof. In some embodiments, various components may be made of one of these materials and other components may be made from another of these materials.

One aspect of the present disclosure is that products are shipped using the shipping container system to keep the product suspended in the outer container. The inner product compartment of the system creates a suspended compartment with an air space above, below, and on all sides of the compartment. Including this space between the outer container and the inner product compartment may provide a safe and secure journey for the product being shipped.

In other embodiments, the system comprises an outer container comprising a base and a plurality of upstanding walls defining a cavity, a first closure flap extending from a top end of one of the upstanding walls opposite the base wherein the first closure flap overlays the base and substantially covers an opening formed by the top ends of the upstanding walls when the outer container is in a closed configuration, and wherein the first closure flap includes a retention element that extends from the closure flap downward into the cavity of the outer container when the outer container is in a closed configuration, and an suspension insert including a product retention compartment and a plurality of suspension units extending outwardly from the suspension unit creating and maintaining a suspension gap on all sides of the product retention compartment when the suspension insert is installed in the outer container; wherein the retention element exerts a retention force on a securing element of a corresponding one of the plurality of suspension units.

In other embodiments, the plurality of upstanding walls includes a pair of side walls and a pair of end walls.

In other embodiments, the system further comprises a second closure flap paired with the first closure flap, the second closure flap arranged to lie underneath the first closure flap when the outer container is in a closed configuration, and wherein the second closure flap includes a retention element aperture through which the retention element passes when the container is in the closed configuration.

In other embodiments, the suspension insert provides security for the product retention chamber in a length of the of the outer container, a width of the outer container, and a height of the outer container.

In other embodiments, the retention force holds the suspension insert secure vertically in a height of the outer container and laterally along a length of the outer container while maintaining the suspension gap between the product retention compartment and the outer container.

In other embodiments, the suspension unit further secures the suspension insert across a width of the outer container while maintaining the suspension gap between the product retention compartment and the outer container.

In other embodiments, the securing element of the suspension unit is a fold between a first section of the suspension unit and a second section of the suspension unit.

In other embodiments, the outer container is formed from a single blank.

In other embodiments, the suspension insert is formed from a single blank.

In other embodiments, the product retention compartment includes a selectively closeable opening.

In other embodiments, the outer container is made from a recyclable material.

In other embodiments, the suspension insert is made from a recyclable material.

In some embodiments, the system comprises an outer container comprising a base, a pair of side walls and a pair of end walls, each side wall and each end wall extending from the base to a top end, the top ends of the side walls and the top ends of the end walls defining an opening, wherein each side wall further comprises a closure flap extending from and hingedly attached to the top end of the side wall and further comprising a retention element wherein the retention element extends from the closure flap at the top end of the container towards the base when the container is in a closed configuration, and wherein each end wall further comprises an inner closure flap extending from and hingedly connected to the top end of the end wall the inner closure flap further comprising a retention element aperture through which the retention element passes when the container is in the closed configuration.

In some embodiments, the system comprises a suspension insert formed from a single blank including an enclosed product retention compartment extending between a first end a second end, further comprising a first suspension unit connected to and extending from the first end of the product retention compartment, a second suspension unit connected to and extending from the second end of the product retention compartment, wherein the suspension units are wider than a width of the product retention compartment and taller than a height of the product retention compartment.

DETAILED DESCRIPTION

Figure 1:
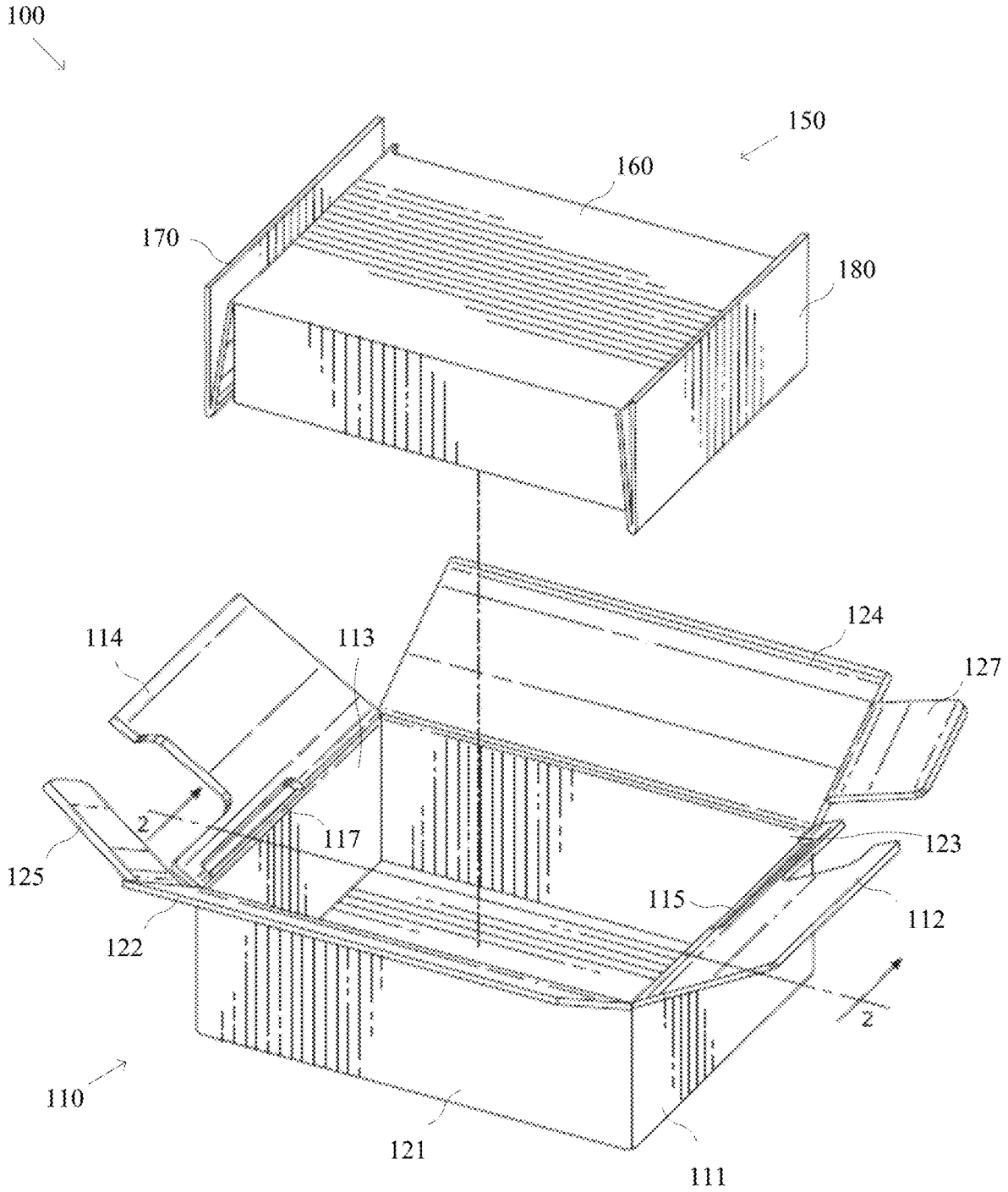
FIG. 1 shows an exploded view of the shipping container system, according to one embodiment of the present disclosure.

The following description contains specific information pertaining to embodiments in the present disclosure. The drawings in the present application and their accompanying detailed description are directed to merely exemplary embodiments. Unless noted otherwise, like or corresponding elements among the figures may be indicated by like or corresponding reference numerals. Moreover, the drawings and illustrations in the present application are generally not to scale and are not intended to correspond to actual relative dimensions.

FIG. 1 shows an exploded view of the shipping container system, according to one embodiment of the present disclosure. Shipping container system 100 includes outer carton 110 and suspension insert 150. Outer carton 110 may be a container used to package a product for shipping. As shown in FIG. 1, outer carton 110 is a rectangular shipping box having a length, width, and height. Outer carton 110 is formed by a rectangular base having a length and a width. In some embodiments, the length of outer carton 110 may be greater than the width of outer carton 110 or the same as the width of outer carton 110. Outer carton 110 includes upstanding walls extending from the sides of the base of outer carton 110. In some embodiments, the upstanding walls extend from the base of outer carton 110 to a top end, the top end of each of the upstanding wall being an end opposite the base of outer carton 110. In some embodiments, the upstanding walls and the base of outer carton 110 define a cavity. In some implementations, the top ends of outer carton 110 define an opening at a top end of outer carton 110 opposite the base of outer carton 110. In some embodiments, outer carton 110 includes closure flaps hingedly attached to and extending from the top ends of one or more of the upstanding walls.

As shown in FIG. 1, the upstanding walls of outer carton 110 include opposing pairs of walls. Specifically, the upstanding walls of outer carton 110 are opposing ends, end 111 and end 113, and opposing sides, side 121 and side 123. The height of the ends may be substantially the same as the height of the sides. As shown in FIG. 1, outer carton 110 includes closure flap 112 extending from the top end of end 111, closure flap 114 extending from the top end of end 113, closure flap 122 extending from the top end of side 121, and closure flap 124 extending from the top end of side 123. Outer carton 110 may be arranged in an open configuration, as shown in FIG. 1. Outer carton 110 may also be arranged in a closed configuration. In the closed configuration, closure flaps 112, 114, 122, and 124 may be rotated about their hinged attachment to ends 111 and 113 and sides 121 and 123 such that the closure flaps are oriented to substantially cover the opening defined by the top ends of the ends 111 and 113 and sides 121 and 123.

As shown in FIG. 1, outer carton 110 includes retention element 125 and retention element 127 hingedly attached to and extending from closure flaps 122 and 124, respectively. In some embodiments, the retention elements may be connected to and extend from a side of their respective closure flaps. In other embodiments, the retention elements may be connected to and extend from a terminal end of the closure flap, the terminal end of the closure flap being opposite the connection to the side of outer carton 110 from which the closure flap extends. When outer carton 110 is arranged in a closed configuration, retention element 125 and retention element 127 may be rotated to a position substantially perpendicular to the plane of closure flaps 122 and 124, respectively, and may extend downwardly from closure flaps 122 and 124 into the cavity of outer carton 110. In other embodiments, outer carton 110 may include a retention element may extend from the terminal end of one or more of closure flaps 122 and 124. In such an embodiment, one or more of closure flaps 122 and 124 may extend substantially across the opening formed by the top ends of the upstanding walls of outer carton 110 and substantially overlay the area of the base of outer carton 110.

Retention elements 125 and 127 may have a width less than half the width of outer carton 110, about the same as the width of outer carton 110, or greater than half the width of outer carton 110.

As shown in FIG. 1, the outer carton 110 includes minor flap 112 and minor flap 114 hingedly connected to and extending from end 111 and end 113, respectively. Minor flaps 112 and 114 may fold inwardly to cover a portion of the opening formed by the top ends of the upstanding walls of outer carton 110. Minor flaps 112 and 114 may be arranged underneath closure flaps 122 and 124 when outer carton 110 is arranged in a closed configuration. As shown in FIG. 1, minor flaps 112 and 114 include apertures 115 and 117, respectively. Apertures 115 and 117 are openings through minor flaps 112 and 114 to receive retention elements 125 and 127 when outer carton 110 is arranged in the closed configuration.

Suspension insert 150 includes product retention compartment 160 having a first end and a second end. Product retention compartment product retention compartment 160 may include an upper section and a lower section. The upper section, the lower section, and the ends of product retention compartment 160 define a volume. In some embodiments, product retention compartment 160 may include side walls extending between the upper section and the lower section. In other embodiments, the volume of product retention compartment 160 may be defined by the upper section and the lower section curving away from each other across the width of product retention compartment 160 in a pillow pack configuration. In other embodiments, product retention compartment 160 may include a plurality of sides defining a volume. The volume may be in any shape, such as a rectangular prism, a pillow pack, a pyramid, a tetrahedron, or other three-dimensional shape that may be used to contain a product for shipping purposes. In some embodiments, product retention compartment 160 may be a custom-made shape designed to fit a particular product.

In some embodiments, the first end of product retention compartment 160 may be selectively closable. The first end of product retention compartment 160 may be selectively closeable by rotating a product retention compartment 160 end flap (not shown) to an orientation across and substantially covering the first end of product retention compartment 160. In some embodiments, the product retention compartment 160 end flap may be a rectangular flap covering width and height of the first end or product retention compartment 160. In other embodiments, the product retention compartment 160 end flap may be oblong or marquise shaped having a width and a curved upper edge and a curved lower edge. In some embodiments, the upper curved edge and the lower curved edge may be substantially symmetrical across an axis extending across the width of the opening of the first end of product retention compartment 160. The end flap of product retention compartment 160 may be hingedly attached to and extend from the lower section of product retention compartment 160 or the upper section of product retention compartment 160.

As shown in FIG. 1, suspension insert 150 includes a suspension unit extending from each end of product retention compartment 160. Suspension unit 170 extends from the first end of product retention compartment 160 and corresponds to the suspension unit extending from the second end of product retention compartment 160. As shown in FIG. 1, suspension unit 170 extends from the upper section of product retention compartment 160 and has a width wider than the width of product retention compartment 160 and a height taller than the height of product retention compartment 160 when arranged to be inserted into outer carton 110. Suspension unit 180 may be substantially the same as suspension unit 170 but extending from the second end of product retention compartment 160.

The components of shipping container system 100 may be made from corrugated board, paper board, flexible plastics, foamed plastics, corrugated plastics, or any combination thereof.

Figure 2:
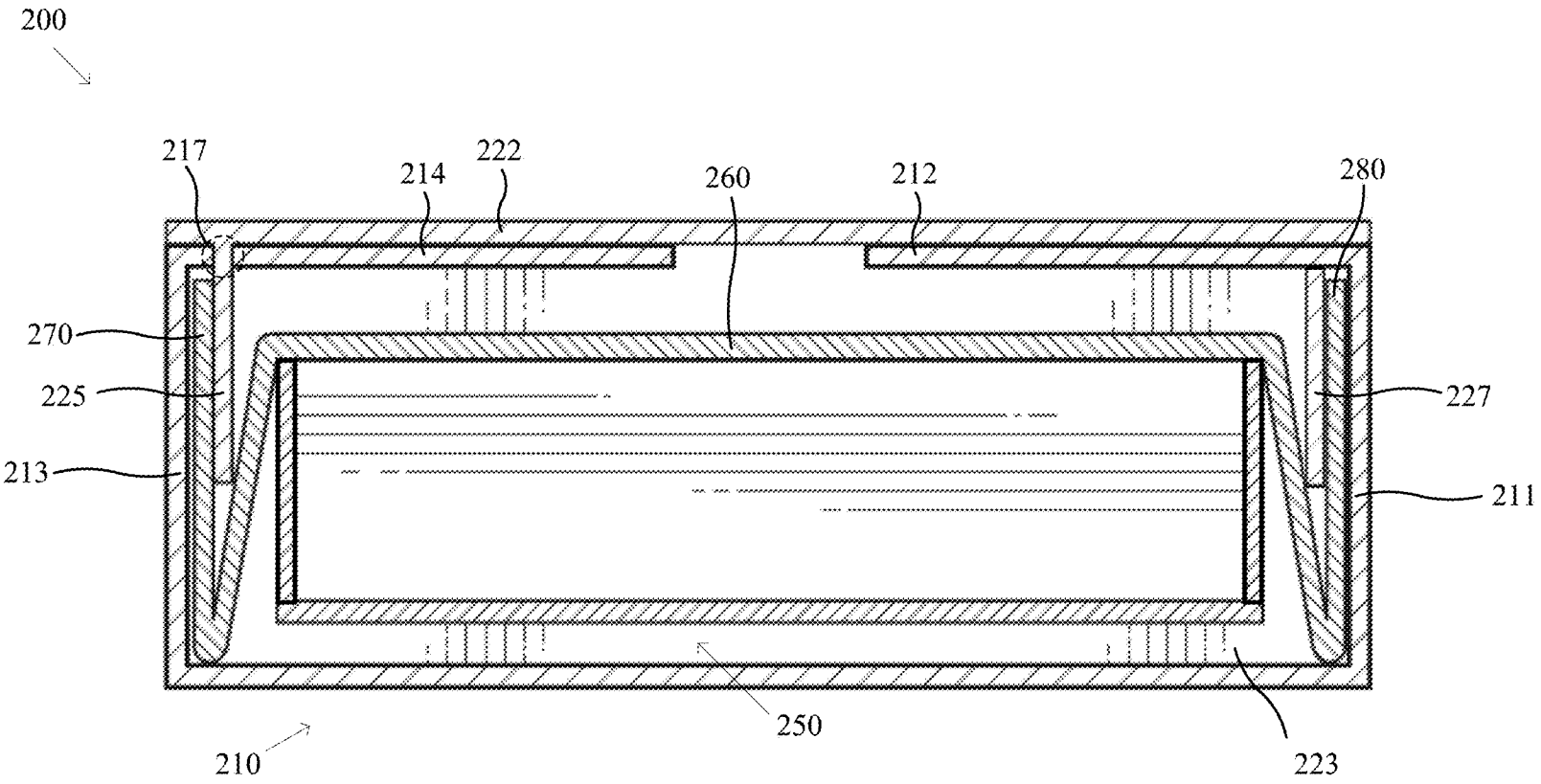
FIG. 2 shows a cross section of the shipping container system of FIG. 1 in a closed configuration, according to one embodiment of the present disclosure.

FIG. 2 shows a cross section of the shipping container system of FIG. 1 in a closed configuration, according to one embodiment of the present disclosure. As shown in FIG. 2, shipping container system 200 includes outer carton 210 and suspension insert 250. The cross-section view depicts the off-center cross section of the shipping container system shown in FIG. 1 arranged in the closed configuration. Outer carton 210 includes ends 211 and 213 from which minor flaps 212 and 214 extend, side 223 visible as the terminal end of shipping container system 200. Retention element 225 is shown extending from closure flap 222 through aperture 217 downwardly into the cavity of outer carton 210.

Retention element 227 is shown extending from closure flap 224 (not visible in the cross-section) downwardly into outer carton 210. Suspension unit 270 and suspension unit 280 are connected to and extend outwardly from the ends of suspension insert 250. Suspension insert 250, including suspension unit 270 and suspension unit 280, is shown to extend the inner length of the cavity in outer carton 210. Suspension unit 270 and suspension unit 280 fill the height of the inner cavity of outer carton 210. As shown in FIG. 2, product retention compartment 260 is suspended inside the cavity of outer carton 210. Shipping container system 200 suspends product retention compartment 260 inside outer carton 210 with open space above, below, and on either end of product retention compartment 260. Although not shown in the view of FIG. 2, product retention compartment 260 is additionally suspended in the width of outer carton 210 by the extension of suspension unit 270 and suspension unit 280 wider than the width of product retention compartment 260 and substantially filling the inner width of the cavity of outer carton 210.

Retention elements 225 and 227 are shown extending down into the cavity of outer carton 210. As shown in FIG. 2, retention elements 225 and 227 secure the terminal sections of suspension unit 270 and suspension unit 280. Folding suspension unit 270 is shown secured between end 213 and retention element 225. Folding suspension unit 280 is shown secured between end 211 and retention element 227. Retention elements 225 and 227 may additionally apply restrict motion of suspension insert 250 in the height of the inner cavity of outer carton 210. Items shipped using shipping container system 200 may be kept secure in shipping by the cushion space above, below, and beside product retention compartment 260 inside outer carton 210.

In some embodiments, retention elements 225 and 227 may extend further down into the height of the cavity of outer carton 210. Retention elements 225 and 227 may press further down and exert pressure on suspension unit 270 and in a downward direction from closure flaps 222 and 224 (not visible in cross section) towards the base of outer carton 210. In some embodiments, retention elements 225 and 227 may extend substantially into the cavity of outer carton 210, such as 50% of the internal height of outer carton 210, 60% of the internal height of outer carton 210, 70% of the internal height of outer carton 210, 80% of the internal height of outer carton 210, 90% of the internal height of outer carton 210, 95% of the internal height of outer carton 210, or 99% of the internal height of outer carton 210. The downward force exerted by retention elements 225 and 227 may provide security and cushioning to product retention compartment 260 and help secure a product transported therein.

Figure 3:
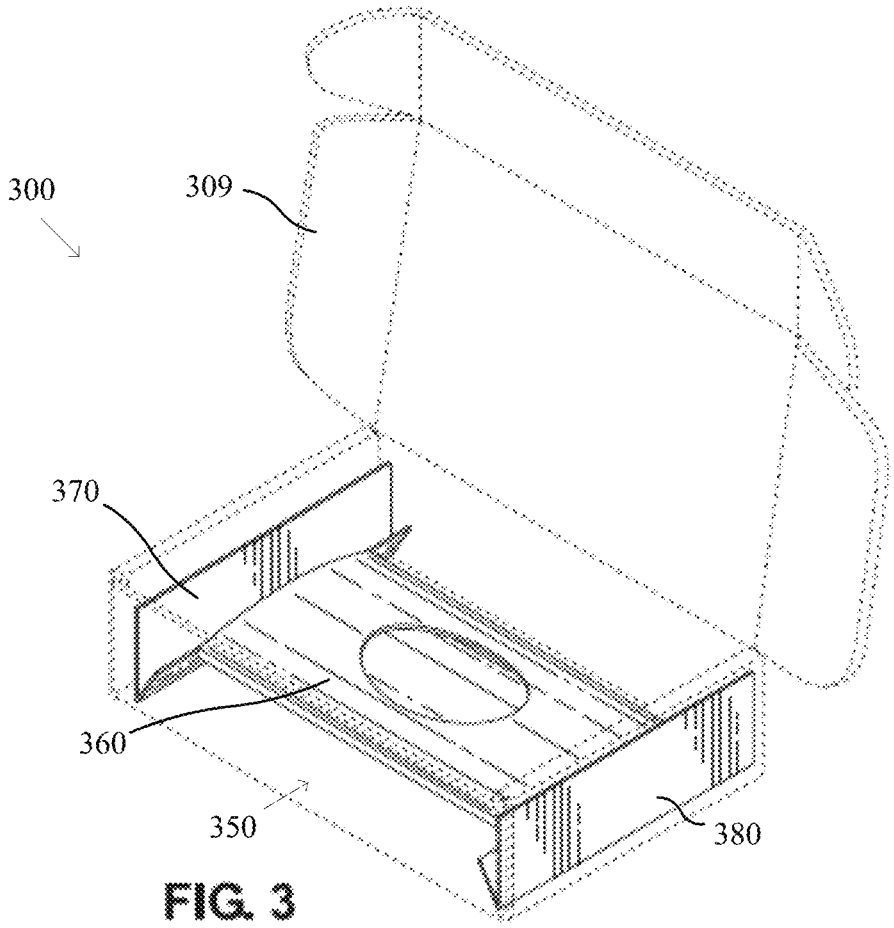
FIG. 3 shows a diagram of another shipping container system, according to one implementation of the present disclosure.

FIG. 3 shows a diagram of another shipping container system, according to one implementation of the present disclosure. Diagram 300 shows suspension insert 350 in a conventional shipping container to demonstrate that suspension insert 350 may secure products in conventional boxes as well and in combination with outer carton 110. As shown in FIG. 3, suspension insert 350 extends, with product retention compartment 360, suspension unit 370, and suspension unit 380 extending thorough the interior length of the cavity of box 309. As shown in FIG. 3, suspension unit 370 and suspension unit 380 extend through the interior height of the cavity of box 309. As shown in FIG. 3, suspension unit 370 and suspension unit 380 extend through the width of the interior cavity of box 309. As shown in FIG. 3, box 309 may have folding flaps that extend down into the cavity of box 309 and may engage with suspension unit 370 and suspension unit 380. In other embodiments, suspension unit 370 and suspension unit 380 secure product retention compartment 360 in the internal cavity of a conventional outer container, such as an easy fold mailing box, a conventional folding carton box, a conventional mailer box, a roll end tuck top style box, a conventional corrugated box, etc.

Figure 4:
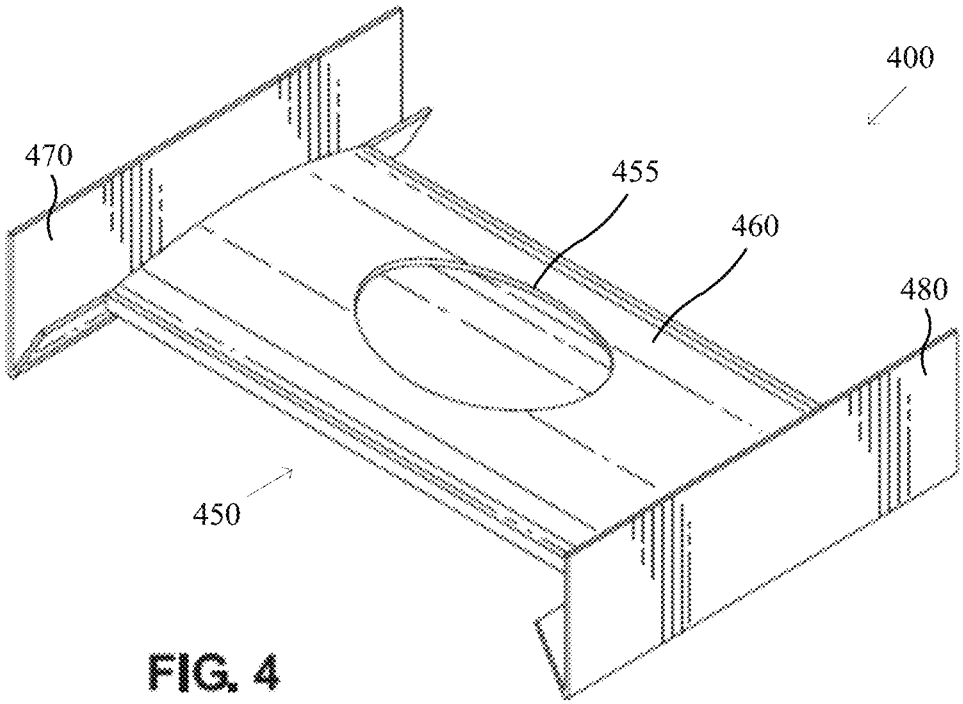
FIG. 4 shows a perspective view of a shipping system suspension unit, according to one implementation of the present disclosure.
Figure 5:
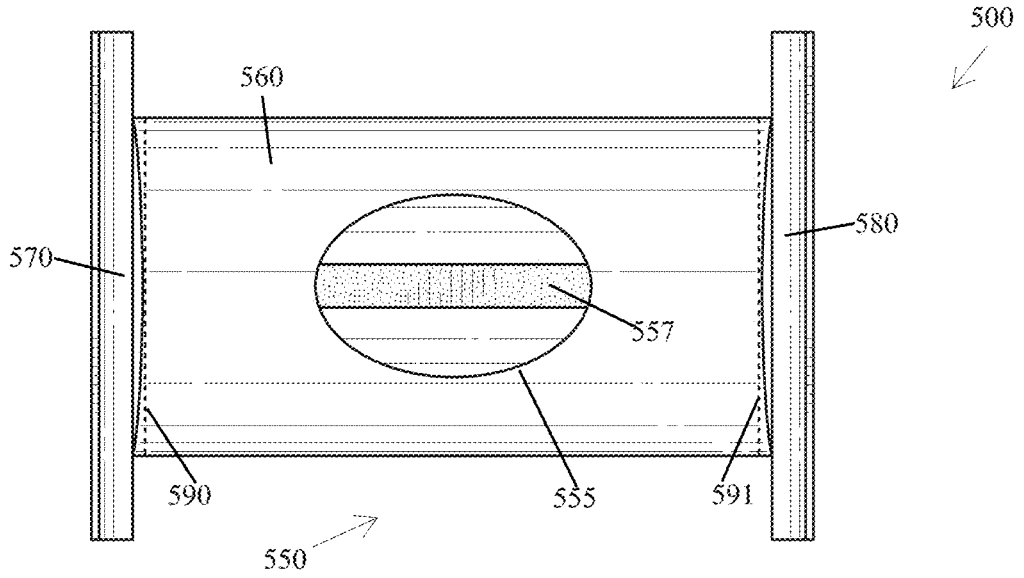
FIG. 5 shows a top view of the shipping system suspension unit of FIG. 4, according to one embodiment of the present disclosure.
Figure 6:
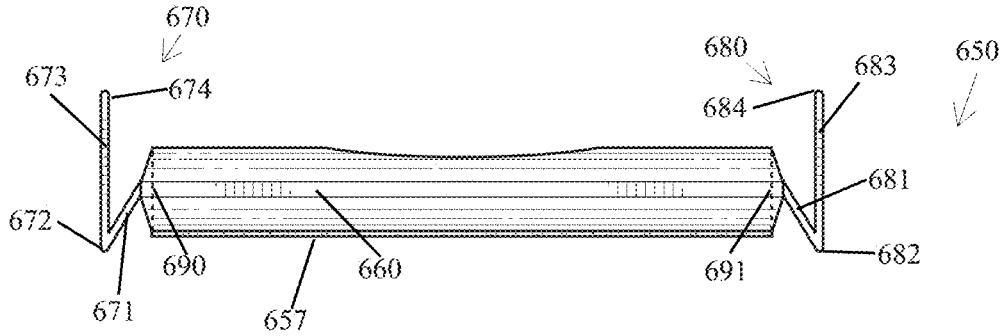
FIG. 6 shows a side view of the shipping system suspension unit of FIG. 4, according to one embodiment of the present disclosure.
Figure 7:
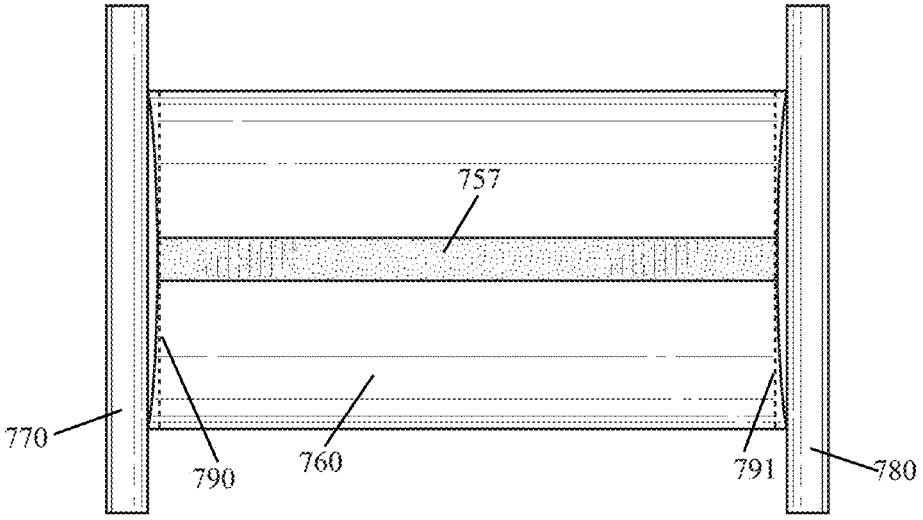
FIG. 7 shows a bottom view of the shipping system suspension unit of FIG. 4, according to one embodiment of the present disclosure.

FIG. 4 shows a perspective view of a shipping system suspension unit, according to one implementation of the present disclosure. Diagram 400 shows suspension insert 450 including product retention compartment 460 extending between suspension unit 470 and suspension unit 480. As shown in FIG. 4, product retention compartment 460 is a pillow pack design formed by a top section of product retention compartment 460 and a lower section of product retention compartment 460. The shape of product retention compartment 460 is a marquise shape formed by tension resulting from an overlapping seam on the bottom section of product retention compartment 460 pulling tension across the top section of product retention compartment 460 and causing the top section to bow upwards and the lower section to bow downwards, where upwards and indicate that the sections are curving or bowing away a center line of product retention compartment 460 extending through the creases on either side of the pillow pack. In some embodiments, product retention compartment 460 may include a marquise-shaped product retention compartment closure flap (as shown in FIG. 5, FIG. 6, and FIG. 7) hingedly connected to and extending from the lower section of product retention compartment 460. The marquise shaped product retention compartment closure flap may be rotated or folded into position to close the ends of product retention compartment 460 for retaining a product, such as a mobile phone, tablet computer, or other electronic device in product retention compartment 460 during shipping.

As shown in FIG. 4, suspension insert 450 includes portal 455. In some embodiments, portal 455 may be an opening cut in the upper section of suspension insert 450. In other embodiments, portal 455 may include a translucent or transparent covering to allow visibility into product retention compartment 460 without leaving a large opening in product retention compartment 460.

FIG. 5 shows a top view of the shipping system suspension unit of FIG. 4, according to one embodiment of the present disclosure. Diagram 500 shows suspension insert 550 including product retention compartment 560, suspension unit 570, and suspension unit 580. As shown in FIG. 5, suspension unit 570 and suspension unit 580 are wider than the width of product retention compartment 560. In some embodiments, the width of suspension unit 570 and suspension unit 580 may be about as wide as the inner dimension of an outer carton used to ship a product held by suspension insert 550. Suspension insert 550 is shown with portal 555 in the top section through which a consumer may view a product contained in product retention compartment 560. As shown in FIG. 5, the view from the top of suspension insert 550 through portal 555 shows the bottom section of product retention compartment 560. A portion of seam 557 is shown, where seam 557 is an overlapping section of the material from which product retention compartment 560 is formed. In some embodiments, product retention compartment 560 may be formed form cardboard and seam 557 may be a seam held together by glue, tape, semi-permanent adhesive, permanent adhesive, radio-frequency (RF) welding, heat bond, locking closures, interlocking closures, stitching, or any other ways to attach or lock the seams.

In some embodiments, suspension insert 550 may be formed from a single blank, such as a single cardboard blank. Suspension insert 550 may be formed by cutting the blank allowing sections to be wrapped downwardly and connected at seam 557, providing the tension to give shape to product retention compartment 560. The product retention compartment closure flap 590, product retention compartment closure flap 591 for selectively closing product retention compartment 560 may be a folded flap extending from the bottom section of product retention compartment 560 or from a side section of product retention compartment 560. In some embodiments, product retention compartment closure flap 590, product retention compartment closure flap 591 may be marquise shaped. In some embodiments, product retention compartment closure flap 590, product retention compartment closure flap 591 may be a section of the blank from which suspension insert 550 is formed that is finished to selectively close product retention compartment 560. In some embodiments, suspension unit 570 and suspension unit 580 may be formed from sections of the blank from which suspension insert 550 is formed finished to extend outwardly from the ends of product retention compartment 560 in an extendable manner, allowing the length of suspension insert 550 to vary based on an inward compression applied from the ends of suspension unit 570 and suspension unit 580 towards product retention compartment 560.

FIG. 6 shows a side view of the shipping system suspension unit of FIG. 4, according to one embodiment of the present disclosure. As shown in FIG. 6, suspension unit 670 and suspension unit 680 extend above and below product retention compartment 660. The folded structure of suspension unit 670 and suspension unit 680 allow the length of suspension insert 650 to adjust to fit the length of an internal cavity of an outer container used to ship a product contained in product retention compartment 660. The folded structure allows suspension insert 650 to secure product retention compartment 660 in the outer container. As shown in FIG. 6, suspension unit 670 and suspension unit 680, when compressed towards product retention compartment 660 as they are when inserted into an outer container, extend above and below product retention compartment 660, allowing suspension insert 650 to suspend product retention compartment 660 and any product contained therein in the outer container. Seam 657 is visible on the bottom side of suspension insert 650. As shown in FIG. 6, in some embodiments, product retention compartment 660 also includes the product retention compartment closure flap 690, product retention compartment closure flap 691. In some embodiments, product retention compartment closure flap 690, product retention compartment closure flap 691 may be marquise shaped.

In some embodiments, the suspension insert may include a securing element. In some embodiments, the securing element may engage one or more of retention elements 125 and 127. The securing element may be a fold between first portion 671 and second portion 673 or the fold between first portion 681 and second portion 683 of the suspension units of the suspension insert. In some embodiments, lower supports 672 and 682 may rest on the base of outer carton 110 and upper supports 674 and 684 may engage the upper end of the cavity of outer carton 110 when outer carton 110 is closed. Thus, the supports extending between 672 and 674, and between 682 and 684, secure the securing insert in the height of outer carton 110. In other embodiments, the securing element by be a gap between an inner portion of the suspension units and an outer portion of the suspension units.

FIG. 7 shows a bottom view of the shipping system suspension unit of FIG. 4, according to one embodiment of the present disclosure. As shown in FIG. 7, seam 757 extends the length of product retention compartment 760. The lower section of product retention compartment 760 is visible with suspension unit 770 and suspension unit 780 extending from either end of product retention compartment 760. As shown in FIG. 7, in some embodiments, product retention compartment 760 also includes the product retention compartment closure flap 790, product retention compartment closure flap 791. In some embodiments, product retention compartment closure flap 790, product retention compartment closure flap 791 may be marquise shaped.

Figure 8:
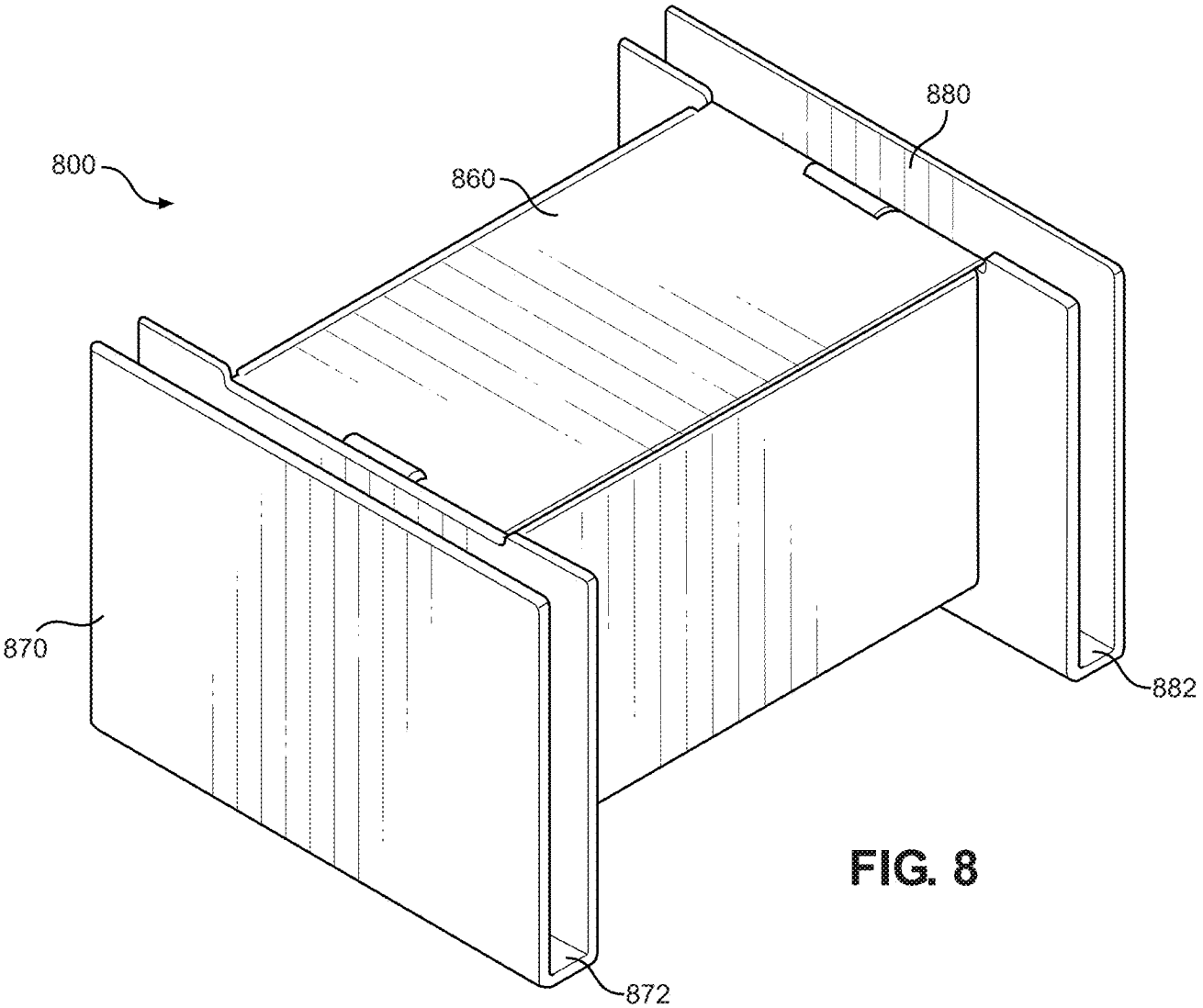
FIG. 8 shows a perspective view of another shipping suspension unit, according to one embodiment of the present disclosure.

FIG. 8 shows a perspective view of another shipping suspension unit, according to one embodiment of the present disclosure. Suspension insert 800 includes product retention compartment 860 extending between suspension unit 870 and suspension unit 880. As shown in FIG. 8, product retention compartment 860 is a rectangular compartment. In some embodiments, suspension unit 870 and suspension unit 880 may be hingedly connected to and extend from the upper section of product retention compartment 860. Suspension unit 870 and suspension unit 880 may be a part of the same blank from which product retention compartment 860 is formed. In such an embedment, suspension unit 870 and suspension unit 880 may be hingedly attached by a fold or folding joint at the edge of the upper section of product retention compartment 860. Suspension unit 870 and suspension unit 880 may be cut with tabs that, when the suspension units are configured for shipping, the tabs extent upward above the upper section of product retention compartment 860. In some embodiments, an additional upper support tab may be cut in the middle of the folding edge joining suspension unit to product retention compartment 860. In such an embodiment, the tabs extent upward from product retention compartment 860 to fill the height of the inner cavity of an outer container, leaving a gap between the outer container and the upper side of product retention compartment 860.

As shown in FIG. 8, suspension unit 870 includes accessory storage section 872 and suspension unit 880 includes accessory storage section 882. The accessory storage sections may be formed by folding components of the suspension units to create a space between the ends of product retention compartment 860 and the internal ends of the outer container. In some embodiments, the accessory storage sections may be used to include accessories such as cables, power cords, remote controls, and other accessories to a product that may be shipped in product retention compartment 860. Accessory storage section 872 and accessory storage section 882 may function as the securing elements of suspension insert 800.

Figure 9:
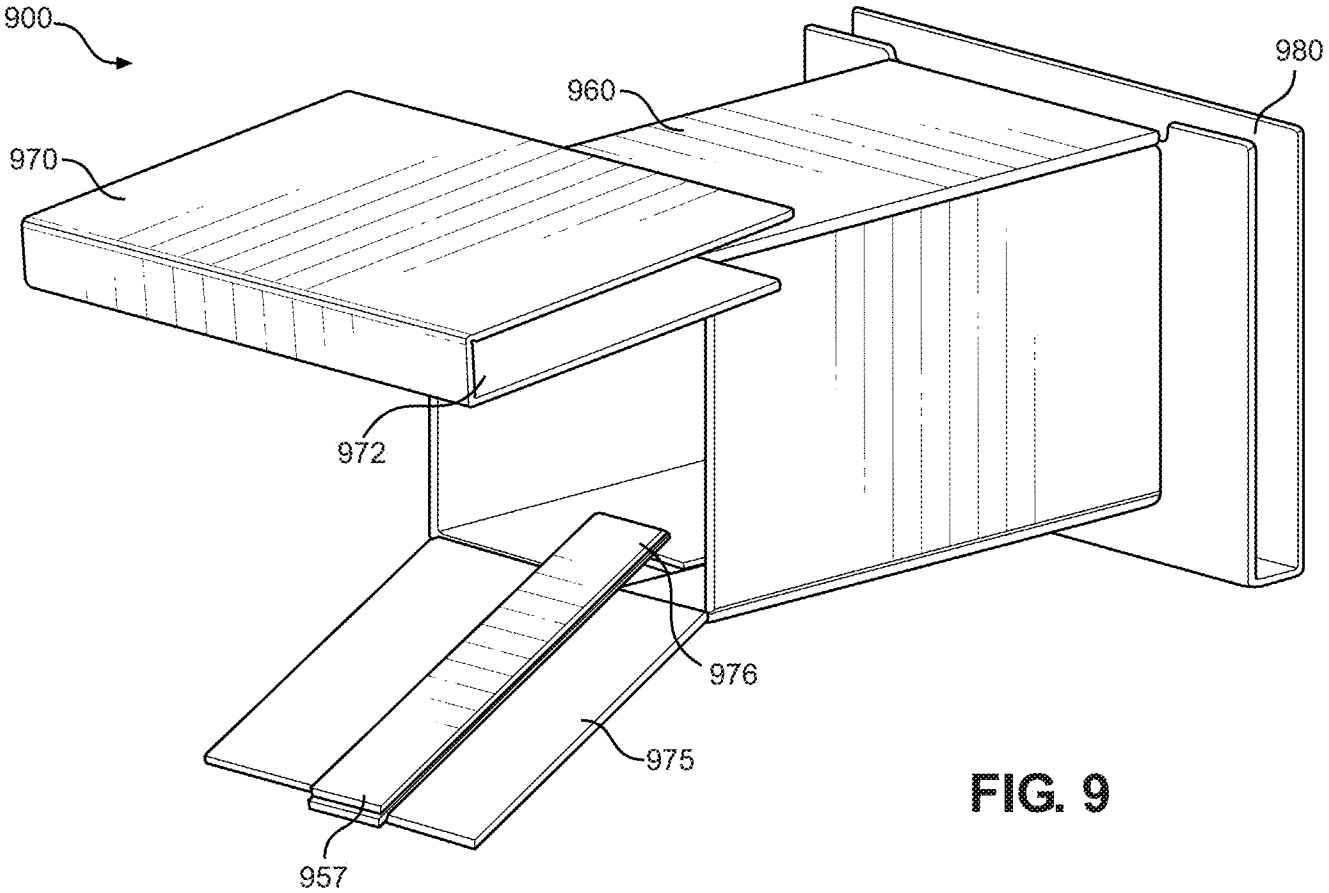
FIG. 9 shows another view of the shipping suspension unit of FIG. 8, according to one embodiment of the present disclosure.

FIG. 9 shows another view of the shipping suspension unit of FIG. 8, according to one embodiment of the present disclosure. Suspension insert 900 is shown with one end of product retention compartment 960 open. Suspension insert 900 includes product retention compartment 960 extending between suspension unit 980 and suspension unit 970 which is shown in an open configuration. As shown in FIG. 9, suspension unit 970 is raised to uncover the end of product retention compartment 960. Selectively closable flap 975 may be a selectively closable flap that may be rotated from an open position, as shown, to a closed position substantially covering the open end of product retention compartment 960. In some embodiments, suspension unit 970 may maintain accessory storage section 972 when suspension unit 970 is in an open position, a closed position, or being transitioned between the open and closed positioned. In some embodiments, both ends of suspension insert 900 may be configured the same such that the end of product retention compartment 960 closed by suspension unit 980 is a mirror image of the end closed by suspension unit 970.

In some embodiments, the selectively closable flap 975 is hingedly attached to the lower section of product retention compartment 960. As shown in FIG. 9, selectively closable flap 975 includes additional structural support element 976 cut out of the lower section of product retention compartment 960. Additional structural support element 976 may be configured to rotate downwardly to create an additional lower support to suspension insert 900 when selectively closable flap 975 is hingedly rotated upward to a closed configuration. Additional structural support element 976 may extend downwardly to the base of the outer container. Thus, when suspension insert 900 is in the closed configuration and installed in an outer container, suspension insert 900 may secure product retention compartment 960 in the length, width, and height of the outer container with an air cushion or physical gap between the top, bottom, and all sides of product retention compartment 960 and the outer container.

Additional structural support element 976 may add additional structural support to the system, strengthening the system in a downward direction securing the product retention compartment in the outer container. In some embodiments, additional structural support element 976 may be a tab cut into the lower section of product retention compartment 960. Additional structural support element 976 may be cut to include seam 957 connecting the flaps of the single blank from which suspension insert 900 is formed. By including seam 957, additional structural support element 976 may provide even more additional structural support.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A container system comprising:

a suspension insert including a product retention compartment defining a volume, the product retention compartment comprising a top section connected to a bottom section and a pair of opposing ends, each of the top section and the bottom section formed from a rigid material, wherein the top section and the bottom section are joined at a seam in the lower section, the seam extending along a length of the product retention compartment, wherein the product retention compartment is a marquise-shaped compartment formed by a tension created by the seam pulling tension across a width of the top section, the product retention compartment further comprising a closure flap at each end of the product retention compartment wherein each closure flap is a marquise-shaped flap hingedly connected to the bottom section of the product retention compartment that can be folded into a closed position to selectively close the product retention compartment, and wherein the product retention compartment comprises a plurality of suspension units extending outwardly from each end of the product retention compartment, and wherein the plurality of suspension units each have a first portion of the suspension unit proximate to and extending from the top section of the product retention compartment extending the first portion of the suspension unit downward toward the bottom section of the product retention compartment and terminating at a fold and a second portion of the suspension unit extending from the fold upwards towards the top section of the product retention compartment, wherein the suspension unit is compressed towards the product retention compartment when the suspension insert is installed in an outer container, wherein a width of the suspension unit is greater than a width of the product retention compartment and the suspension unit extends past each side of the product retention compartment, and wherein a height of the suspension unit is greater than a height of the product retention compartment, and wherein a length of the suspension insert including the suspension units is greater than a length of the product retention compartment, thereby creating a suspension gap on all sides of the product retention compartment when the suspension insert is installed in an outer container.

2. The container system of claim 1, wherein the outer container comprises a base and a plurality of upstanding walls defining a cavity in which to install the suspension insert, and wherein a maximum height of the plurality of suspension units when installed in the outer container is taller than a height of the product retention compartment and shorter than an interior height of the outer container.

3. The container system of claim 2, wherein the plurality of upstanding walls includes a pair of side walls and a pair of end walls.

4. The container system of claim 2, wherein the first direction is a downward direction extending towards the base of the outer container when the suspension insert is installed in the outer container and the second direction is an upwards direction extending away from the base of the outer container when the suspension insert is installed in the outer container; and wherein a lid of the outer container has folding flaps that engage with the plurality of suspension units when the folding flaps extend down into a space between the first portion and the second portion of the plurality of suspension units as the lid closes the outer container.

5. The container system of claim 1, wherein the suspension insert includes an aperture in the top section of the product retention compartment allowing visibility into the product retention compartment.

6. The container system of claim 1, wherein the seam on the lower section of the product retention compartment is held together by at least one of a glue, a tape, a semi-permanent adhesive, a permanent adhesive, a radio-frequency (RF) welding, a heat bond, a locking closure, an interlocking closure, and a stitching.

7. The container system of claim 1, wherein the suspension insert provides security for the product retention compartment in a length of the of the outer container, a width of the outer container, and a height of the outer container.

8. The container system of claim 1, wherein a retention force exerted by the plurality of suspension units against opposing walls of the outer container holds the suspension insert secure in a height of the outer container and along a length of the outer container while maintaining the suspension gap between the product retention compartment and the outer container.

9. The container system of claim 1, wherein the plurality of suspension units is wider than a width of the product retention compartment.

10. The container system of claim 1, wherein the suspension insert is formed from a single cardboard blank.

11. The container system of claim 1, wherein the suspension insert is formed from one of corrugated board, paper board, flexible plastics, foamed plastics, rigid plastics, and corrugated plastics.

12. The container system of claim 1, wherein the suspension units compress towards the product retention compartment when inserted into an outer container and the plurality of suspension units extend above and below a height of the product retention compartment.

13. The container system of claim 1, wherein the product retention compartment includes a selectively closeable opening.

14. The container system of claim 1, wherein the suspension insert is made from a recyclable material.

15. The container system of claim 1, wherein the plurality of suspension units each include a lower support that rests on a base of the outer container and an upper support that engages with an upper end of the outer container when the outer container is closed.

16. A container system comprising:

an outer container; and a suspension insert;

wherein the outer container has a first closure flap hingedly connected to a top end of one of the plurality of upstanding walls opposite the base wherein the first closure flap overlays the base and substantially covers an opening formed by the top ends of the upstanding walls and wherein the first closure flap includes one or more folding flaps that extend downward engaging with the plurality of suspension units when the folding flaps extend down into a space between the first portion and the second portion of the plurality of suspension units when the outer container is in a closed configuration; and wherein the suspension insert including a product retention compartment defining a volume, the product retention compartment comprising a top section connected to a bottom section and a pair of opposing ends, each of the top section and the bottom section formed from a rigid material, wherein the top section and the bottom section are joined at a seam in the lower section, the seam extending along a length of the product retention compartment, wherein the product retention compartment is a marquise-shaped compartment formed by a tension created by the seam pulling tension across a width of the top section, the product retention compartment further comprising a closure flap at each end of the product retention compartment wherein each closure flap is a marquise-shaped flap hingedly connected to the bottom section of the product retention compartment that can be folded into a closed position to selectively close the product retention compartment, and wherein the product retention compartment comprises a plurality of suspension units extending outwardly from each end of the product retention compartment, and wherein the plurality of suspension units each have a first portion of the suspension unit proximate to and extending from the top section of the product retention compartment extending the first portion of the suspension unit downward toward the bottom section of the product retention compartment and terminating at a fold and a second portion of the suspension unit extending from the fold in upwards towards the top section of the product retention compartment, wherein the suspension unit is compressed towards the product retention compartment when the suspension insert is installed in an outer container, wherein a width of the suspension unit is greater than a width of the product retention compartment and the suspension unit extends past each side of the product retention compartment, and wherein a height of the suspension unit is greater than a height of the product retention compartment, and wherein a length of the suspension insert including the suspension units is greater than a length of the product retention compartment, thereby creating a suspension gap on all sides of the product retention compartment when the suspension insert is installed in the outer container.

17. The container system of claim 16, wherein each of the plurality of suspension units extending from the product retention compartment are wider than a width of the product retention compartment and a height of the folded structure of the plurality of suspension units when installed in the outer container is greater than a height of the product retention compartment such that the plurality of folding suspension units maintain a front air gap, a rear air gap, a top air gap, a bottom air gap, a left air gap, and a right air gap between the product retention compartment and each side of the outer container.

* * * * *